US006578235B2

(12) United States Patent
Womack et al.

(10) Patent No.: US 6,578,235 B2
(45) Date of Patent: Jun. 17, 2003

(54) UNIVERSAL INSIDE-OUTSIDE DOOR HANDLE

(75) Inventors: Michele Rene Womack, Carrollton, TX (US); LeRoy G. Krupke, Carrollton, TX (US); Richard K. Hoofard, Dallas, TX (US); Thomas S. Skinner, Flower Mound, TX (US)

(73) Assignee: Overhead Door Corporation, Dallas, TX (US)

( * ) Notice: Subject to any disclaimer, the term of this patent is extended or adjusted under 35 U.S.C. 154(b) by 0 days.

(21) Appl. No.: 09/853,476

(22) Filed: May 11, 2001

(65) Prior Publication Data

US 2002/0166210 A1 Nov. 14, 2002

(51) Int. Cl.[7] ..... A45C 13/22
(52) U.S. Cl. ..... 16/412; 16/413; 16/414
(58) Field of Search ..... 16/412, 413, 422, 16/444, 414, 382; 49/460, 394

(56) References Cited

U.S. PATENT DOCUMENTS

| | | | | | |
|---|---|---|---|---|---|
| 1,079,121 | A | * | 11/1913 | Giese | 16/414 |
| 1,386,740 | A | * | 8/1921 | Subroyar | 16/414 |
| 1,487,264 | A | | 3/1924 | Raymer | |
| 2,576,511 | A | | 11/1951 | Jewett | |
| 2,589,516 | A | * | 3/1952 | Stelzer | 16/402 |
| 2,717,168 | A | * | 9/1955 | Patterson | 16/412 |
| 2,882,549 | A | * | 4/1959 | Strauss | 16/412 |
| 3,017,657 | A | | 1/1962 | Mills | |
| 3,222,732 | A | | 12/1965 | Miller | |
| 4,499,629 | A | | 2/1985 | Grossman | |
| 4,641,462 | A | | 2/1987 | Markus | |
| 4,912,809 | A | | 4/1990 | Scheuer | |
| 6,250,044 | B1 | * | 6/2001 | Funk et al. | 211/105.2 |
| 2002/0078530 | A1 | * | 6/2002 | Tasman | 16/412 |

* cited by examiner

*Primary Examiner*—Anthony Knight
*Assistant Examiner*—Mark Williams
(74) *Attorney, Agent, or Firm*—Gardere Wynne Sewell LLP

(57) ABSTRACT

A handle assembly, particularly adapted for a sectional door panel includes identical handle parts each having a grip portion and spaced apart transversely extending legs. One of the legs of each handle part has an elongated shank extending therefrom and the other leg of each handle part has a shorter shank or a shank receiving bore formed therein. The handle parts are assembled to each other from opposite sides of a door panel and secured by conventional threaded fasteners which extend through a bore in one leg of each handle part and engage a shank of the other handle part. Tubular spacers may be sleeved over the shanks of the handle parts to limit the spacing between the handle parts during assembly to the door panel.

15 Claims, 3 Drawing Sheets

UNIVERSAL INSIDE-OUTSIDE DOOR HANDLE

FIELD OF THE INVENTION

The present invention pertains to a handle assembly for a door or door panel wherein identical handle parts are disposed on both sides of the door and are interconnected with each other to form the handle assembly.

BACKGROUND

Handle assemblies which are required to be disposed for grasping from both sides of a door or door panel are widely known. Manual grips or handles are required for some doors, such as residential garage doors, on both the inside and outside of the door for use in lifting the door. This requirement is provided for sectional upward acting garage doors, in particular, to avoid causing persons to use the door section pinch points to move the door up and down.

Accordingly, it is desirable to provide a handle assembly which is mechanically uncomplicated, easy to assemble and use and requires few parts. It is also desirable to provide a handle assembly which has a high degree of commonality of parts and may be adapted to be used with doors having a relatively wide range of door panel thicknesses. It is to satisfy the above described needs and desiderata that the present invention has been developed.

SUMMARY OF THE INVENTION

The present invention provides an improved handle assembly, particular adapted for use with sectional garage doors and the like, which handle assembly may be gripped from inside as well as outside a door to manually move the door.

In accordance with one aspect of the present invention, a handle assembly is provided which is particularly adapted for a sectional door panels and the like and which includes two handle parts and two fasteners wherein the handle parts are of identical construction and the fasteners are of identical construction. The handle assembly is particularly easy to install and may be installed on door panels of different thicknesses. In this regard, the handle parts are each formed with opposed legs, an interconnecting grip portion and wherein one of the legs includes an elongated reduced cross section shank portion which projects through the door panel and is received in a bore formed in the other leg of the other handle part. In this way, the handle parts may be assembled using elongated screw type fasteners. The handle cannot be disassembled by removing a fastener from only one side of the door panel.

The lengths of the shank portions and the depths of the shank receiving bores in the respective handle parts may be adapted to use the handle with door panels of different thicknesses or the length of the shank and bore portions may be dimensioned such that only minimal deflection, if any, of the panel parts is possible when the handle parts are assembled to each other to prevent over-tightening of the handle parts and bending or plastic deflection of the door panel parts. The handle parts may include shank portions extending from both legs of the handle to aid in locating the handles in spaced apart bores on a door panel and to provide for reducing the height or depth of the handle with respect to the plane of the door panel. The handle assembly may also include elongated tubular spacers extending between and sleeved over the shank portions to limit the bending or deflection of door panel parts.

In accordance with another aspect of the present invention, a molded plastic handle part is provided for a handle assembly, particularly adapted for use as an inside outside handle assembly for a sectional garage door and the like.

Those skilled in the art will further appreciate the advantages and superior features of the invention upon reading the detailed description which follows in conjunction with the drawing.

DETAILED DESCRIPTION OF PREFERRED EMBODIMENTS

Figure 1:
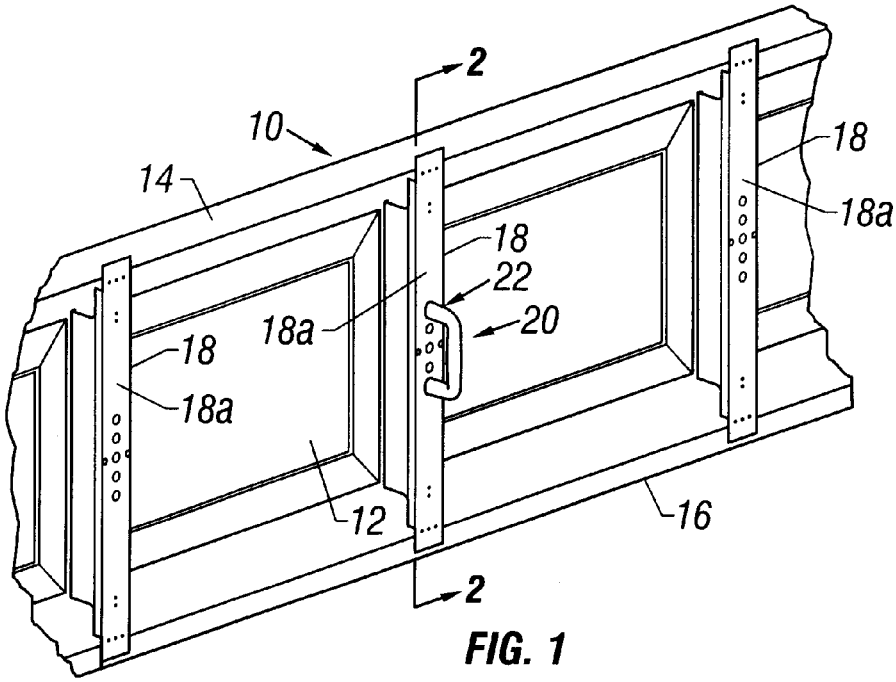
FIG. 1 is a perspective view of part of a sectional garage door panel showing a portion of the handle assembly of the present invention mounted thereon.

In the description which follows, like parts are marked throughout the specification and drawing with the same reference numerals, respectively. The drawing figures are not necessarily to scale and certain features may be shown exaggerated in scale in the interest of clarity and conciseness.

Referring to FIG. 1, there is illustrated a portion of a garage door panel 10 for a sectional garage door, for example. The garage door panel 10 includes an outer front face or skin 12, an upper transverse edge 14 and a lower transverse edge 16. The panel 10 may be formed of sheet metal which is bent to form the outer face 12 and the upper and lower transverse edges. Spaced apart channel-shaped reinforcing stiles 18 extend between the opposed edges 14 and 16 and are suitably secured thereto to reinforce the panel 10. Alternatively, the panel 10 may be characterized by an insulation-filled panel with an inner skin, not shown, extending between the edges 14 and 16 and suitably secured thereto in a known manner. In such constructions, the stiles 18 may be omitted. However, the door panel 10 includes an outer, generally planar skin such as the skin or face 12 and an inner structural member providing a generally planar face such as the surface provided by the web 18*a* of the channel-shaped stiles 18.

Figure 3:
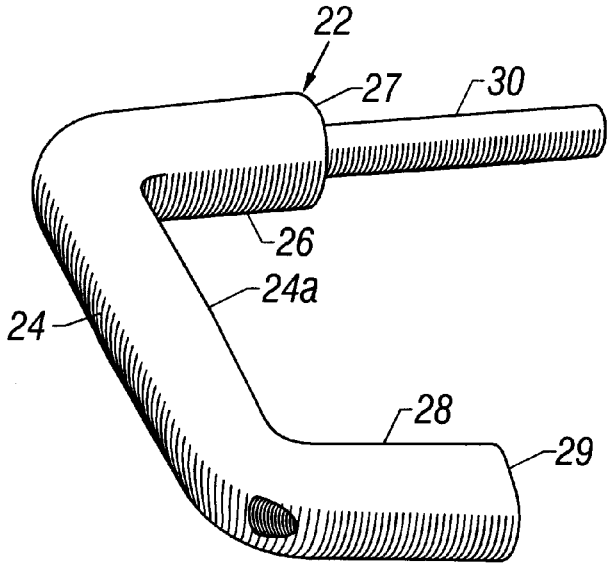
FIG. 3 is a perspective view of one of the handle parts for the handle assembly of the invention.
Figure 2:
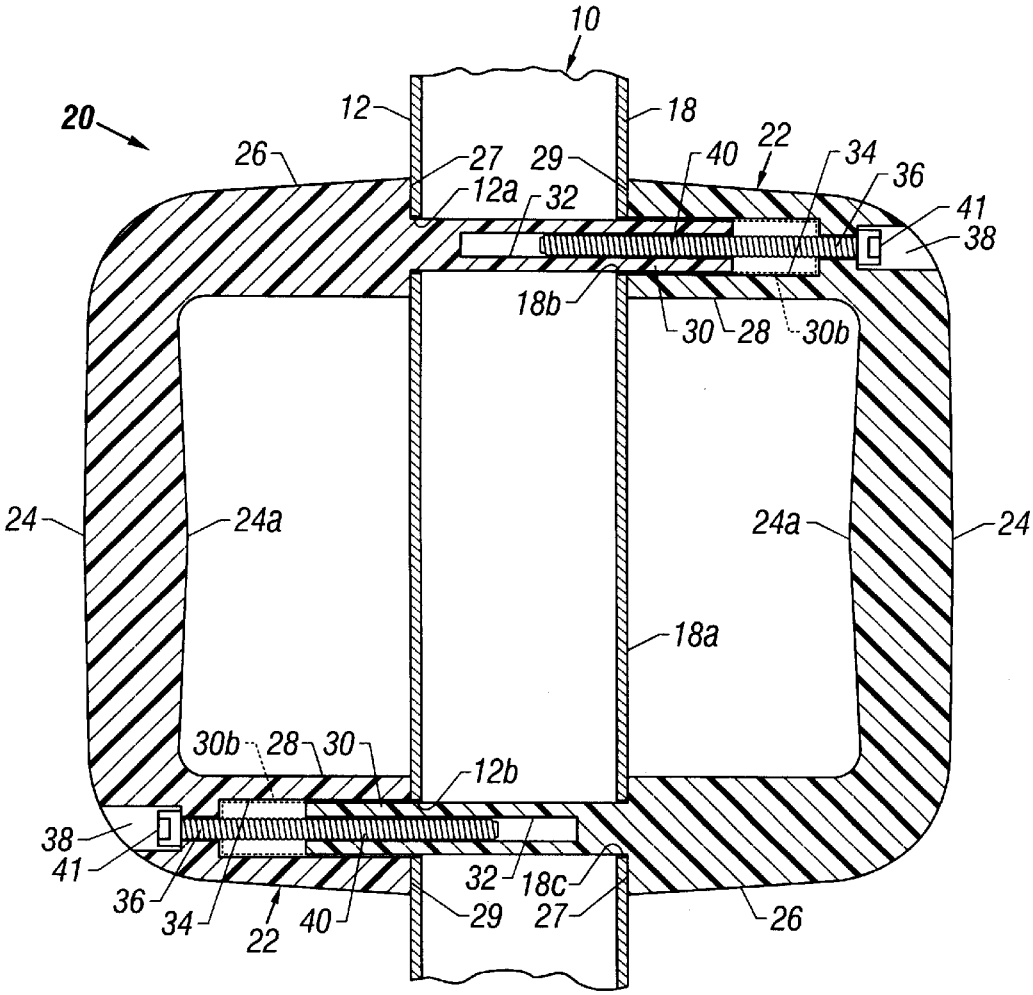
FIG. 2 is a section view taken generally along the line 2—2 of FIG. 1.

Referring to FIGS. 1, 2 and 3, the door panel 10 is fitted with a universal inside-outside handle assembly, generally designated by the numeral 20. Handle assembly 20 includes opposed, identical handle parts 22, see FIG. 2. Each of the handle parts 22 is characterized as a molded plastic part including a grip portion 24 extending between and formed integral with opposed legs 26 and 28 which extend generally transversely to the grip portion 24 and parallel to each other. The grip portion 24 is preferably of non-uniform cross section to provide a thicker cross section crest portion 24*a* to facilitate ease of gripping and pulling on the handle assembly 20. Handle leg 26 includes a reduced cross section elongated shank portion 30, preferably of cylindrical cross section. Shank portion 30 is provided with an internal longitudinal cylindrical bore 32 which may be pre-threaded or threaded by a self-tapping fastener when the handle parts 22 are assembled to form the handle assembly 20. Shank portion 30 extends longitudinally from the leg 26 and a transverse end face 27 is formed at the juncture of leg 26 with shank 30.

Leg 28 of handle part 22 includes a transverse end face 29 which is co-planar with the end face 27 and is intersected by a bore 34 which is parallel to the shank portion 30 and the bore 32 and is slightly larger in diameter than the diameter of the shank portion 30. As further shown in FIG. 2, bore 34 is intersected by a coaxial reduced diameter bore 36 which is intersected by a coaxial counterbore 38 opening to the exterior of the handle part 22 in a direction opposite the bore 34 and end face 29.

As further shown in FIG. 2, the panel 10 may be provided with suitable spaced-apart openings 12*a* and 12*b* in outer face 12 and corresponding openings 18*b* and 18*c* formed in the inner face or web 18*a* of stile 18. Openings 12*a* and 18*b* are aligned and openings 12*b* and 18*c* are aligned, each set of openings being adapted to receive a shank 30 for one of the handle parts 22, as illustrated. When the handle parts 22 are assembled to the panel 10 in the manner shown in FIG. 2, the shanks 30 project into the bores 34 and suitable threaded fasteners 40 are inserted through the bores 36 from the counterbores 38 and are in threaded engagement with the respective shanks 30 to secure the handle parts to each other and to the panel 10. The lengths of the shanks 30 may be such as to provide for using the handle parts 24 with panels of various thicknesses between faces 12 and 18*a*, for example. Accordingly, the depths of the bores 34 are also sufficient to accommodate varying degrees of telescoping entry of the shanks 30 within the bores. Alternatively, the shanks 30 may be pre-dimensioned for particular door panel thicknesses so that the shanks extend fully within the bores 34 when the handle parts are assembled to the door so that, upon tightening the fasteners 40, the skin or face 12 and/or the face or web 18*a* will not be severely deflected. Alternate lengths of the shanks 30 to meet the last mentioned requirement are indicated by numeral 30*b* in FIG. 2.

The handle parts 22 are preferably formed of a suitable injection moldable plastic, such as Nylon or Polypropylene. The fasteners 40 may have heads of conventional configuration and the depths of the counterbores 38 are such as to allow full recession of the fastener heads 41 within the bores 38, as shown in FIG. 2.

Figure 4:
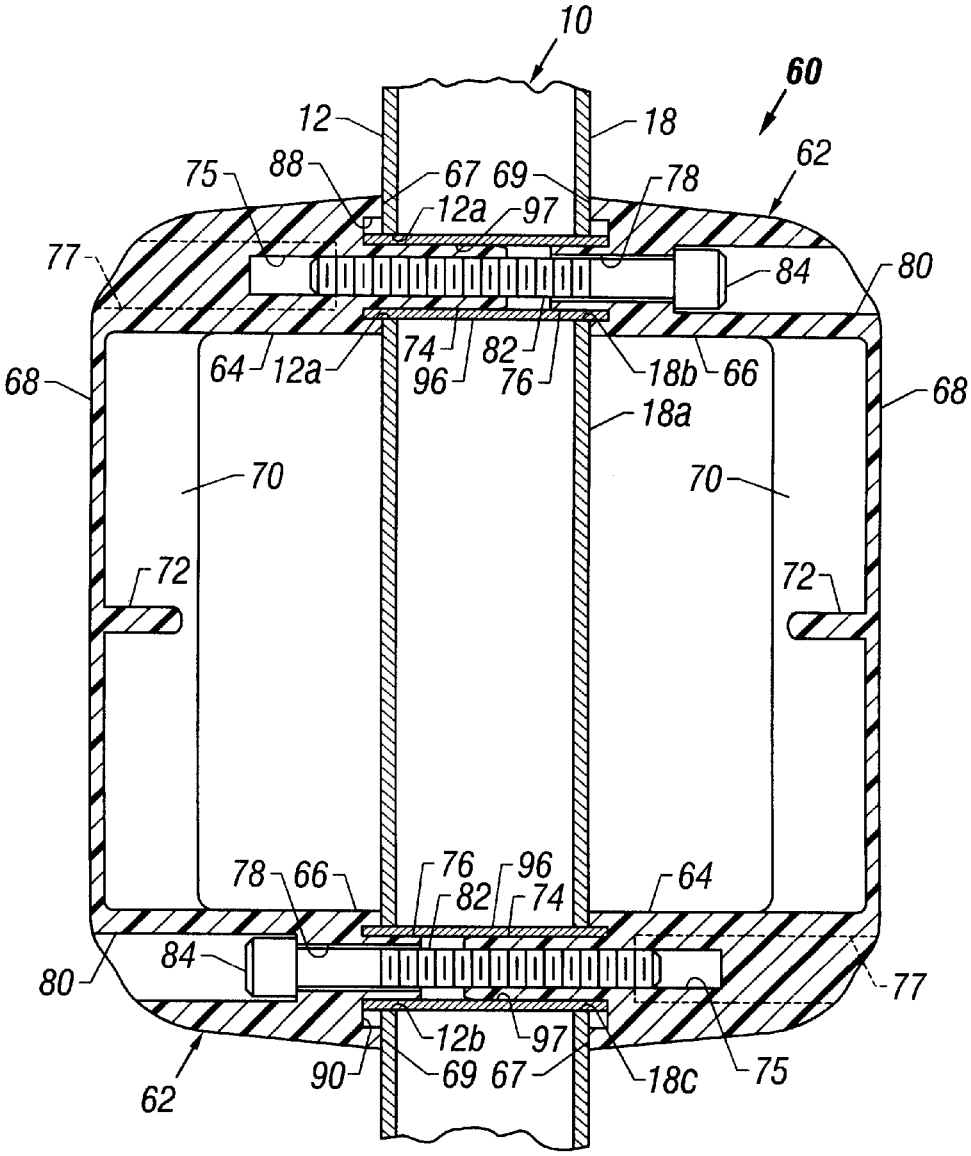
FIG. 4 is a section view taken from generally the same line as the section view of FIG. 2 showing an alternate embodiment of a handle assembly in accordance with a present invention.

Referring now to FIG. 4, there is illustrated an alternate embodiment of a handle assembly in accordance with the invention and generally designated by the numeral 60. The handle assembly 60 is shown mounted on a door panel 10 in place of the handle assembly 20. The handle assembly 60 includes identical handle parts 62, which are similar in some respects to the handle parts 22 and include, respectively, spaced apart generally parallel extending leg parts 64 and 66 and a connecting grip portion 68. The grip portion 68 may have a somewhat hollow channel shaped cross section to provide a trough 70 and a transverse reinforcing rib 72 to reduce the cross section thickness and weight of the handle part 62. The handle parts 62 may be formed of the same molded material as the handle parts 22.

The handle parts 62 each include respective long and short shank portions 74 and 76 extending generally parallel to each other axially from the respective legs 64 and 66. Shank portion 74 includes a suitable fastener receiving bore 75 extending therewithin and which may open to a counterbore 77 which may or may not be provided in the leg 64. In like manner an axial bore 78 extends through shank portion 76 and part of leg 66 and opens to a counterbore 80 for receiving a suitable threaded fastener 82 having a head 84. Fasteners 82 are similar to the fasteners 40. Fasteners 82 may be of the self-tapping type to threadedly engage the shank portions 74 and legs 64 of the respective handle parts 62, as shown by the assembly drawing of FIG. 4. Shank portions 74 and 76 extend longitudly from the legs 64 and 66 and transverse end faces 67 and 69 are formed on the legs 64 and 66 for forcible engagement with the faces or skin parts 12 and 18 of the door panel 10.

Figure 5:
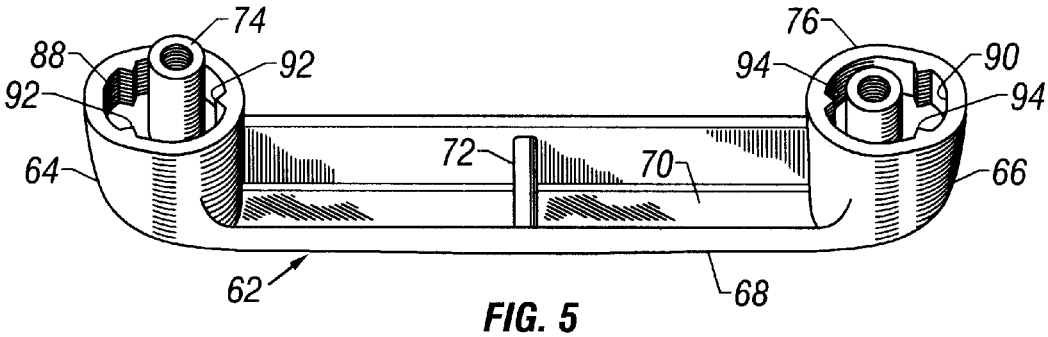
FIG. 5 is a perspective view of one of the handle parts for the handle assembly shown in FIG. 4.

Referring further to FIGS. 4 and 5, the handle parts 62 each preferably include annular recesses 88 and 90 disposed around the respective shank portions 74 and 76, as shown in the drawing figures. The recess 88 is provided with circumferentially spaced radially inwardly projecting standoff ribs 92, two shown in FIG. 5, and recess 90 is also provided with circumferentially spaced radially inwardly projecting standoff ribs 94, three shown in FIG. 5. The ribs 92 and 94 extend axially with the recesses 88 and 90 and are operable to journal elongated cylindrical tubular spacer members 96, FIG. 4, extending between opposed handle parts 62, as shown in FIG. 4. The spacers 96 limit the movement of the handle parts 62 toward each other when the fasteners 82 are tightened to prevent deflection of the panel parts 12 and 18*a*, for example. The tubular spacers 96 are a snug fit in the recesses 88 and 90, thanks to the provision of the supporting ribs 92 and 94, which engage the outer surfaces of the spacers 96. In this way, a spacer 96 may be assembled in telescoping relationship over the shank portions 74 and 76 of one of the handle parts 62 while that handle part is assembled to the door panel 10 and the other handle part 62 may then also be engaged with the spacers 96 by extending the respective shank portions 74 and 76 within the tubular bores 97 of the spacers during assembly of the handle assembly 60. The diameters of the respective openings 12*a*, 12*b*, 18*b* and 18*c* in the skin part 12 and the web 18*a* are, of course, modified to be large enough to receive the spacers 96 extending therethrough, as shown in FIG. 4.

The handle assembly 60 enjoys all of the advantages of the handle assembly 20 but has a shorter depth profile between the grip portion 68 and the door panel 10. Moreover, the handle assembly 60 may also be used with door panels of various thicknesses thanks to the configuration of the handle parts 62. The respective shank portions 74 and 76 will abut each other when used with a door of a pre-selected minimum thickness. However, the use of tubular spacers of selected lengths is preferred to minimize the chance of deflection of the door panel parts.

The fabrication and assembly of the handle parts 22 and 62 to form the handle assemblies 20 and 60 is believed to be within the purview of one of ordinary skill in the art based on the foregoing description. The handle assemblies 20 and 60 are particularly advantageous due to the commonality of parts and ease of assembly. Moreover, by proper dimensioning of the length of the shank portions of the respective handle parts and the depth of the shank receiving bore 34 of the respective handle parts 22, the handle assembly 20 may also be adapted for use with a wide variety of door panel thicknesses. For example, it is not unusual for garage door panel thicknesses to vary between one inch and two inches. Accordingly, the handle parts 22 and 62 and the spacers 96 may be easily dimensioned to accommodate a wide range of panel thicknesses without requiring different parts or different fasteners 40 and 82. The handle assemblies 20 and 60 are preferably oriented vertically on a door panel 10, as indicated in FIGS. 1, 2 and 4.

Another important advantage of the present invention resides in providing the handle parts 22 and 62 of each handle assembly of different colors. For example, a handle assembly 20 may be provided with a first handle part 22 which is almond colored and a second handle part 22 which is colored white. In this way, if the door panels are normally provided in either almond or white color, then the handle part 22 of the same color may, for example, be mounted on the outside of the door panel for aesthetic purposes. The respective handle parts 62 for a given handle assembly 60 may also be of two separate colors for the purpose described above as well as for selection of a particular color by the door user Although preferred embodiments of the invention have been described in detail herein, those skilled in the art will appreciate that various substitutions and modifications may be made without departing from the scope and spirit of the invention as set forth in the appended claims.

What is claimed is:

1. An inside-outside handle assembly for a door panel, said door panel including structure means forming opposed spaced apart faces, said handle assembly including opposed, substantially identical handle parts adapted for mounting on said opposed faces, respectively, and secured to each other to form said handle assembly;

said handle parts each include a grip portion and opposed spaced apart legs; and elongated fasteners required to be inserted in bores formed in one leg of each of said handle parts from opposite sides of said door panel and connected to the other leg of the other of said handle parts to secure said handle assembly to said door panel.

2. The handle assembly set forth in claim 1 wherein:

said legs each include a transverse face engageable with one of said opposed faces of said door panel.

3. The handle assembly set forth in claim 1 wherein:

said legs extend generally transversely from said grip portion, one of said legs includes an elongated shank part and the other of said legs includes a shank receiving bore for receiving the shank part of the opposed handle part when said handle parts are mounted on said door panel, and said fasteners are engaged with said shank parts, respectively, for securing said handle parts to each other.

4. The handle assembly set forth in claim 3 wherein:

the lengths of said shank parts and the depths of said shank receiving bores in said other legs are predetermined to allow securing said handle parts to each other on door panels of various thicknesses.

5. The handle assembly set forth in claim 3 wherein:

the lengths of said shank parts and the depth of said shank receiving bores in said other legs are predetermined such that when said handle parts are assembled to each other and secured to each other by said fasteners, said shank parts will engage said other legs to minimize deflection of said structure means of said door panel.

6. The handle assembly set forth in claim 1 wherein:

said legs extend generally transversely from said grip portion, each of said legs including a shank part extending axially from said leg, respectively, and adapted to be aligned with a shank part of the opposed handle part when the handle parts are mounted on said door panel, and said fasteners extend within the shank parts of said handle parts, respectively, and are engageable with said handle parts for securing said handle parts to each other.

7. The handle assembly set forth in claim 6 wherein:

the lengths of said shank parts are predetermined to allow securing said handle parts to each other on door panels of various thicknesses.

8. The handle assembly set forth in claim 6 including:

elongated spacer members extending between said handle parts and sleeved over said shank parts, respectively, and operable to minimize deflection of said structure means of said door panel when said handle parts are secured to each other.

9. The handle assembly set forth in claim 8 wherein:

the legs of said handle parts include recesses formed therein for receiving opposite ends of said spacers in snug fitting relationship.

10. The handle assembly set forth in claim 1 wherein:

said handle parts are formed of molded plastic selected from a group consisting of reinforced nylon and polypropylene.

11. The handle assembly set forth in claim 1 wherein:

one of said handle parts is of a first color and the other of said handle parts is of a second color and at least one of said first and second colors corresponds to the color of at least a part of said door panel.

12. An inside-outside handle assembly for a door panel, said door panel including structure means forming opposed spaced apart faces, said handle assembly including opposed, substantially identical handle parts adapted for mounting on said opposed faces, respectively, and secured to each other to form said handle assembly, said handle parts each include a grip portion and opposed spaced apart legs, said legs each including a transverse surface engageable with one of said opposed faces of said door panel, and elongated fasteners inserted in bores formed in each of said handle parts and engageable with the other of said handle parts only from opposite sides of said door panel to secure said handle assembly to said door panel.

13. An inside-outside handle assembly for a door panel, said door panel including structure forming opposed spaced apart faces, said handle assembly including opposed, substantially identical molded plastic handle parts adapted for mounting on said opposed faces, respectively, and secured to each other to form said handle assembly, said handle parts each include a grip portion and opposed spaced apart legs extending generally transversely from said grip portion, one of said legs including an elongated shank part and the other of said legs including a bore for receiving the shank part of the opposed handle part when said handle parts are mounted on said door panel, elongated fastener means inserted in a fastener receiving bore formed in one of the legs of each of said handle parts and engageable with the other leg of the other of said handle parts, respectively, for securing said handle parts to each other, and the lengths of said shank parts are predetermined to allow securing said handle parts to each other on door panels of various thicknesses.

14. An inside-outside handle assembly for a door panel, said door panel including structure forming opposed spaced apart faces, said handle assembly including opposed, substantially identical molded plastic handle parts adapted for mounting on said opposed faces, respectively, and secured to each other to form said handle assembly, said handle parts each include a grip portion and opposed spaced apart legs extending generally transversely from said grip portion, each of said legs including a shank part alignable with the shank part of the opposed handle part when said handle parts are mounted on said door panel, elongated fastener means supported on one of the legs of each of said handle parts and engageable with the other of said handle parts, respectively, for securing said handle parts to each other, and elongated tubular spacers disposed in sleeved relationship over said shank parts and extending between and engaged with said handle parts, respectively, and operable to minimize deflection of said faces of said door panel toward each other when said handle parts are secured to said door panel.

15. The handle assembly set forth in claim 14 wherein:

said legs of said handle parts include recesses formed therein for receiving opposite ends of said spacers, respectively.

* * * * *